US012709367B2

(12) United States Patent
Parkes et al.

(10) Patent No.: US 12,709,367 B2
(45) Date of Patent: Aug. 18, 2026

(54) LIFE PRESERVER

(71) Applicant: SURVITEC GROUP LIMITED, London (GB)

(72) Inventors: Nigel Parkes, Salisbury (GB); Simon Davey-Evans, Fareham (GB)

(73) Assignee: SURVITEC GROUP LIMITED, London (GB)

( * ) Notice: Subject to any disclaimer, the term of this patent is extended or adjusted under 35 U.S.C. 154(b) by 893 days.

(21) Appl. No.: 17/759,573

(22) PCT Filed: Jan. 26, 2021

(86) PCT No.: PCT/EP2021/051763

§ 371 (c)(1),
(2) Date: Jul. 27, 2022

(87) PCT Pub. No.: WO2021/151894

PCT Pub. Date: Aug. 5, 2021

(65) Prior Publication Data

US 2023/0094472 A1 Mar. 30, 2023

(30) Foreign Application Priority Data

Jan. 27, 2020 (GB) ..... 2001111

(51) Int. Cl.
*B63C 9/15* (2006.01)
*B63C 9/13* (2006.01)

(52) U.S. Cl.
CPC ..... *B63C 9/155* (2013.01); *B63C 2009/133* (2013.01)

(58) Field of Classification Search
CPC . B63C 9/155; B63C 2009/133; B63C 9/1255; B63C 9/081

(Continued)

(56) References Cited

U.S. PATENT DOCUMENTS 4,297,758 A * 11/1981 Moran ..... B63C 9/1255 441/123
RE31,305 E * 7/1983 Moran ..... B63C 9/1255 441/118
2013/0212764 A1 8/2013 Kent

FOREIGN PATENT DOCUMENTS

FR 1377151 A 10/1964
GB 647188 A 12/1950

(Continued)

OTHER PUBLICATIONS

International Search Report and Written Opinion for International Application No. PCT/EP2021/051763 mailed May 4, 2021.

(Continued)

*Primary Examiner* — Daniel V Venne
(74) *Attorney, Agent, or Firm* — Maschoff Brennan

(57) ABSTRACT

A life preserver (1) including an inflatable main body portion (3) having an aperture (5) for a wearer's neck, and first and second inflatable lobes (7, 9) extending from the main body portion which are configured to respectively occupy a position on the left and right hand side of the wearer's body when in use. The main body portion may be formed by corresponding front and rear layers of material that are connected around their outer peripheries and which each have an aperture for the wearer's neck, wherein the main body portion further comprises an additional layer of material that is connected to the front and rear layers of material around the apertures in the front and rear layers to form a surface that, upon inflation of the main body portion, encircles the wearer's neck. A panel (15) of material mounted on a front surface of the main body portion adjacent to, or partially overlying, the neck aperture may protect the wearer's airways from water splashes.

16 Claims, 5 Drawing Sheets

(58) Field of Classification Search
USPC ..... 441/123
See application file for complete search history.

(56) References Cited

FOREIGN PATENT DOCUMENTS

| | | | |
|---|---|---|---|
| GB | 679610 | A | 9/1952 |
| GB | 707289 | A | 4/1954 |
| GB | 870877 | A | 6/1961 |
| GB | 1014214 | A | 12/1965 |
| GB | 1503975 | A | 3/1978 |
| GB | 2162129 | A | 1/1986 |
| WO | 2007048606 | A2 | 5/2007 |

OTHER PUBLICATIONS

Search Report for Application No. GB2001111.0 mailed on Jun. 23, 2020.

* cited by examiner

LIFE PRESERVER

TECHNICAL FIELD

The present invention relates to a life preserver.

BACKGROUND TO THE INVENTION

Conventional life preservers, such as lifejackets, include an inflatable main body portion for providing buoyancy for the wearer so that the wearer's head is supported above the surface of the water in order to prevent drowning. Lifejackets typically include an opening for the wearer's head and neck.

A number of challenges exist with the use and performance of known inflatable lifejackets. Such lifejackets must be easy and simple and quick to don in an emergency and by a wide range of different wearer anthropometrics and different wearer ages etc. When in the water and inflated the lifejacket must provide protection from drowning even in rough sea conditions. The lifejacket should preferably do four things when in the water even if the wearer is unconscious:

- Ensure the wearer is turned to a face-up position if inverted and face-down and unconscious (self-righting).
- Support the wearer and the wearer's head so the airways are well clear of the water (by at least 120 mm).
- Support the body and head so that the angle of the face is at least 40° to the horizontal water surface (face plane angle), and the body is generally supported in an effective way such that the wearer can swim and if needed to climb out of the water for recovery or rescue.
- Be designed such that the performance will be maintained even in rough seas and will not "ride up" over the wearer's head etc.

Traditional "twin lobe" split-front lifejackets generally have two symmetrical lobes which lie on opposite sides of the front a wearer's torso. Such lifejackets have the benefit that they are easy to don and are comfortable to wear when uninflated but have the disadvantage, when inflated and in the water, that the lobes form a channel between them that will allow waves to splash onto the mouth and also do not hold the head firmly. Such lifejackets are also wide when inflated as measured across the lobes which restricts arm movements when needed such as swimming and climbing a ladder. Such lifejackets also normally require a "back strap" to hold the lifejacket down so it does not "ride up" around the head for example when jumping into the water. Additionally, the spacing and orientation of the twin lobes make self-righting from a face down attitude in the water difficult.

Single lobe lifejackets have a single lobe that lies over the wearer's chest and a neck portion that lies behind the wearer's neck, with an aperture for the wearer's head. Such lifejackets have the benefit that when inflated the single lobe does not form a channel for water to the wearer's airways. They also have better self-righting characteristics that twin lobe lifejackets. However, to make the lifejacket secure when inflated around the neck the neck aperture must not be too large. Consequently, such lifejackets are difficult to don over the head particularly if wearing a bulky jacket or coat with a hood.

Embodiments of the present invention seek to provide an improved life preserver.

SUMMARY OF THE INVENTION

According to a first aspect of the present invention there is provided a life preserver including an inflatable main body portion formed by corresponding front and rear layers of material that are connected around their outer peripheries and which each have an aperture for a wearer's neck, wherein the main body portion further comprises additional layer of material that is connected to the front and rear layers of material around the apertures to form a surface that, upon inflation of the main body portion, encircles the wearer's neck.

The surface may be configured to grip the wearer's neck on inflation, which will tend to prevent the life preserver riding up over the wearer's head. The aperture, when the life preserver is deflated, can consequently be made larger so that the life preserver is easier to don but which still fits securely around the wearer's neck once inflated.

The additional layer of material may be formed from two joined sheets of material that are configured to lie within and parallel to the corresponding front and rear layers of material prior to inflation of the main body portion.

In a second aspect the life preserver includes a panel of material mounted on a front surface of the main body portion adjacent to, or partially overlying, the neck aperture for protecting the wearer's airways from water splashes.

Preferably a portion of the panel adjacent to, or partially overlying, the neck aperture is further coupled to the main body portion by a strap arrangement that passes through the neck aperture and is mounted to a rear surface of the main body portion.

In the embodiment the panel is mounted over a component attached to the main body portion, such as an inflation system for the main body portion and the first and second inflatable lobes. This may prevent damage caused by snagging of the component during movement of the wearer.

According to a third aspect of the present invention there is provided a life preserver including an inflatable main body portion having an aperture for a wearer's neck, and first and second inflatable lobes extending from the main body portion which are configured to respectively occupy a position on the left and right hand side of the wearer's body when in use.

Such an arrangement may avoid some of the disadvantages of a conventional twin lobe lifejacket described above. For example, the main body portion having an aperture for a wearer's neck from which the first and second inflatable lobes extend may not allow a direct passage between the lobes to the wearer's mouth as this is blocked by the main body portion. However, the provision of the two lobes may provide the life preserver with improved self-righting properties and/or improved height of mouth/face plane angle.

In the embodiment to be described the life preserver is configured such that at least one of the lobes extends obliquely or perpendicularly with respect to an adjacent surface of the wearer's torso when in use.

The first and second inflatable lobes may occupy a position on the left and right hand side of the front of the wearer's torso when in use. This may provide the life preserver with improved self-righting properties. For example, the first and second inflatable lobes are coupled together at a position spaced apart from the main body portion such that adjacent facing edges of the first and second inflatable lobes abut one another in use, the first and second inflatable lobes moving independently of one another and tending to cause self-righting of the wearer when lying face down in water. The first and second inflatable lobes may coupled together by a strap arrangement that also mounts the life preserver to the wearer's waist in use.

The first and second inflatable lobes may occupy a position on the left and right hand side of the back of the wearer's torso when in use. This may provide improved height of mouth/face plane angle for the wearer. The first and second inflatable lobes may coupled together at a position spaced apart from the main body portion so that the first and second inflatable lobes extends obliquely or perpendicularly with respect to the back of the wearer's torso.

In the embodiment the life preserver includes a first set of the first and second inflatable lobes that occupy the position on the left and right hand side of the front of the wearer's torso when in use and a second set of the first and second inflatable lobes that occupy the position on the left and right hand side of the wearer's back when in use.

The life preserver may be configured such that the main body portion is formed by corresponding front and rear layers of material that are connected around their outer peripheries and which each have an aperture for the wearer's neck, wherein the main body portion further comprises additional layer of material that is connected to the front and rear layers of material around the apertures in the front and rear layers to form a surface that, upon inflation of the main body portion, encircles the wearer's neck. The surface may grip the wearer's neck on inflation.

A life preserver in accordance with the invention may include any one of, or any combination of, the first, second and third aspects referred to above.

The lifejacket of the embodiment to be described may overcome the problems of the prior art as follows:

- There are twin lobes that form into a single lobe on the upper chest area thus creating a barrier to wave splash.
- The two lobes can move independently so that they can create a "rolling" to aid self-righting effect from a face down position.
- The lifejacket has a panel in the neck area that when inflated "grips" the neck to tend to stop the lifejacket riding up over the wearer's head.
- There is a wave splash guard in front of the wearer's mouth that reduces water impact onto the airways which is supported by two straps. This guard may also cover and protect the inflation system from being "snagged" etc.
- There is a buoyancy portion behind the wearer's head which extends into two side lobes which are drawn together over the back of the shoulders by straps and in combination with the buoyancy portion behind the head may greatly increase the support to the head/neck area and increase the mouth freeboard. It also may provide a face plane angle of at least 40° to the water surface. The side lobes may also increase the lateral and occipital support so that the head does not "loll" if the wearer is unconscious.

All of the features described herein may be combined with any of the above aspects, in any combination.

BRIEF DESCRIPTION OF THE DRAWINGS

For a better understanding of the present invention an embodiment will now be described by way of example, with reference to the accompanying drawings, in which.

In the drawings like elements are generally designated with the same reference sign.

DETAILED DESCRIPTION OF EMBODIMENT OF THE INVENTION

Figure 1:
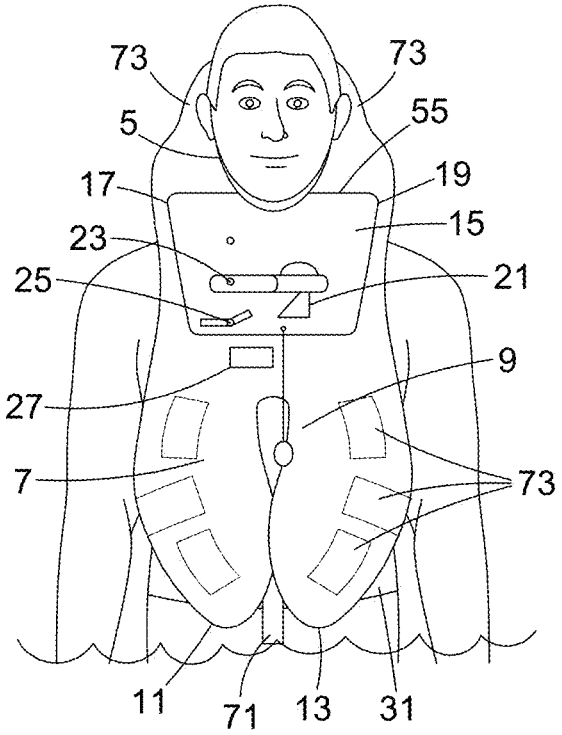
FIG. 1 shows a plan view of the front of a life preserver (that will face away from a wearer's chest in use), when worn by the wearer, according to the embodiment of the invention.
Figure 2:
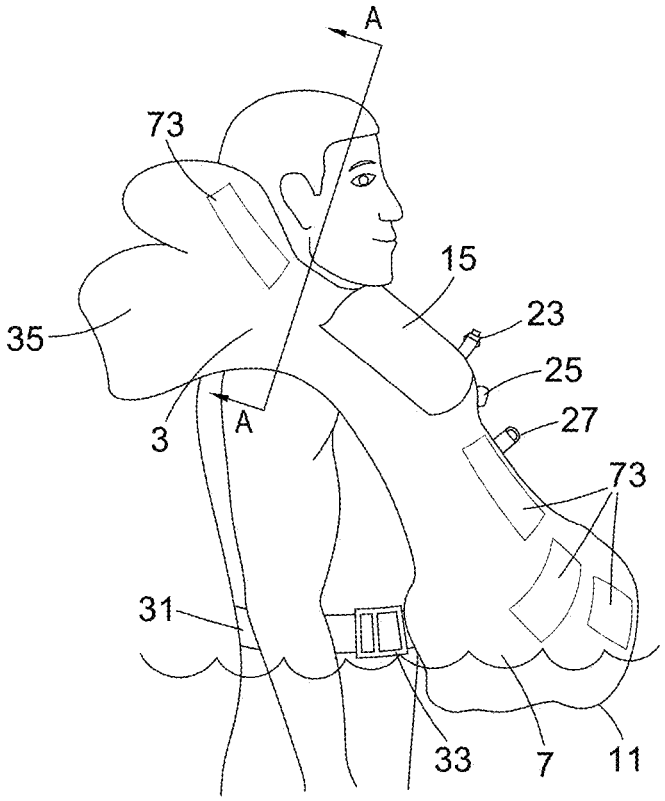
FIG. 2 shows a right side view of the life preserver (in use), when worn by the wearer, according to the embodiment of the invention (the opposite side corresponds)

Referring initially to FIGS. 1 and 2, there is shown a life preserver 1, such as a lifejacket. The life preserver 1 includes a main body portion 3 having an aperture 5 for surrounding a wearer's neck when in use.

The life preserver 1 further includes first and second inflatable torso buoyancy sections 7 and 9 which form symmetrically disposed lobes that lie on opposite sides of a wearer's torso. First, proximal ends of the first and second torso buoyancy sections 7, 9 are joined to the main body portion 3. The first and second torso buoyancy sections 7, 9 are preferably integrally formed with the main body portion 3 so that a common inflation chamber extends between the first and second torso buoyancy sections 7, 9 and the main body portion 3. The first and second torso buoyancy sections 7, 9 each extend from said first, proximal end to a second end 11, 13, which is a distal end.

The life preserver 1 is generally symmetrical about a longitudinal centre line that extends between the first and second torso buoyancy sections 7, 9.

When inflated, each torso buoyancy section 7, 9 may be an elongate member of generally elliptical or oval cross section.

A waist strap 31 is connected to the bottom surface (the surface facing the wearer's body in use) of each of the buoyancy sections 7 and 9 near the distal ends 11 and 13 thereof and extends around the wearer's waist in use. Ends of the strap 31 are coupled and decoupled from one another by a releasable buckle 33 and shown in FIG. 2.

In use, the first and second torso buoyancy sections 7 and 9 extend in a direction generally obliquely or perpendicularly to the chest of the wearer (rather than lying parallel to chest of the wearer as for a conventional lifejacket). This may be achieved by selecting the a point of attachment 47 and 49, respectively, of the waist strap 31 (see FIG. 4) to the first torso buoyancy section 7 and to the second torso buoyancy section 9 and the fixed length of waist strap 31 between those points 47 and 49 such that, when the life preserver 1 is inflated the adjacent facing edges 51 and 53 of the first and section buoyancy sections 7 and 9 are pressed together and the first and section buoyancy sections 7 and 9 rotate away from each other, pivoting about the respective points of attachment 47 and 49. This tends to cause the first and second torso buoyancy sections 7 and 9 to extend generally obliquely or perpendicularly to the wearer's chest.

Without the waist strap 31 there would be a distance, D, between the points of attachment 47 and 49 when the first and second torso buoyancy sections 7 and 9 lie parallel to chest of the wearer when the life preserver 1 is inflated with the adjacent facing edges 51 and 53 of the first and section buoyancy sections 7 and 9 abutting one another. According to the embodiment, the length of the strap between the points of attachment 47 and 49 is selected to be less than D so that the first and second torso buoyancy sections 7 and 9 cannot lie parallel to chest of the wearer and are forced to rotate about the points of attachment 47 and 49 so that the first and second torso buoyancy sections 7 and 9 extend in a direction generally obliquely or perpendicularly to the chest of the wearer.

Figure 8:
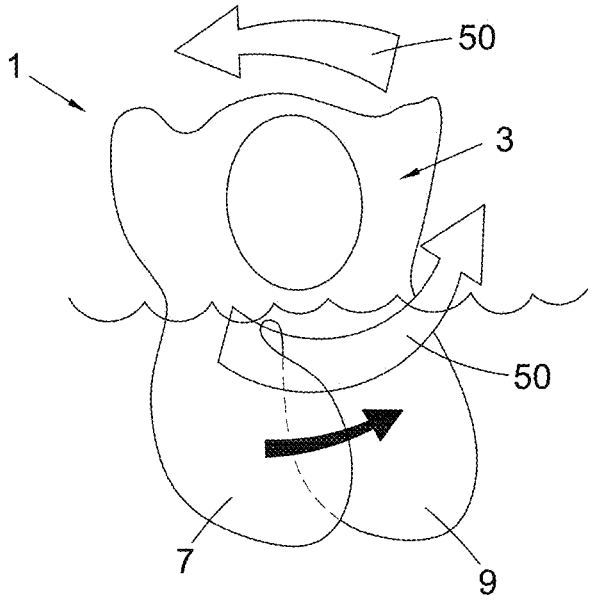
FIG. 8 shows an overhead view of the life preserver fitted to the torso of the wearer lying face-down in water.

The first and second torso buoyancy sections 7 and 9, although connected to one another by the waist strap 31, can still rotate by varying amounts about the pivot points created at the points of attachment 47 and 49. The arrangement of the torso buoyancy 7 and 9 sections is advantageous in the event that the wearer is lying facing the surface of water, as shown in FIG. 8, which might happen when the wearer is unconscious in an emergency situation. The orientation and freedom to independently rotate of the torso buoyancy sections 7 and 9 allows the torso buoyancy sections to move independently of one another to create a rolling effect to aid self-righting, i.e. so that the wearer rotates through 180 degrees, as indicated by arrows 50, so that the wearer faces away from the surface of the water.

The arrangement of the waist strap 31 and the first and second buoyancy sections 7 and 9 means that the life preserver 1 is unstable in water when the wearer is lying face down in the water and one or other of the torso buoyancy sections 7,9 will move relative to the other, which will cause the life preserver and the wearer to rotate into the desired upwardly facing position.

The oblique or perpendicular orientation of the torso buoyancy sections 7,9 reduces the overall width of the life preserver 1, providing less restriction to wearer arm movements than a conventional twin lobe lifejacket and so making swimming easier.

As mentioned above, the first and second torso buoyancy sections 7,9 are generally elliptical or oval in transverse cross-section, the width dimension being greater than the depth dimension. The torso buoyancy sections 7,9 rotate relative to the main body portion 3 so that the larger dimension, instead of overlying and being generally parallel to the chest of the wearer, extends generally perpendicular to or obliquely to the chest of the wearer.

A wave splash guard panel 15 is attached to the main body portion 3 at a position just below, or partially obscuring, the neck aperture 5. The splash guard panel 15 may be generally rectangular or trapezoidal in shape, although other shapes may be used. The splash guard panel 15 is attached to the main body portion 3 at least partially along its side edges 17 and 19.

An inflation cartridge, partially shown at 21 contains compressed gas (e.g. $CO_2$) for inflating the life preserver 1. The inflation cartridge 21 can be manually or automatically activated. The inflation cartridge 21 is positioned on the front surface of the main body portion 3 and is partially covered by the splash guard panel 15, which reduces the likelihood of the inflation cartridge 21 being caught on another object and causing damage to the life preserver 1 during evacuation or other movements of the wearer.

The life preserver 1 is also inflatable by a mouth-operable inflator 23 to allow manual inflation in the event of failure of the inflation cartridge 21 or to top up the inflation pressure. A non-return valve and a closure cap may prevent water flowing down the inflator 23 and into the inflation chamber of the life preserver 1. The inflator 23 passes through an opening in the splash guard panel 15 and lies over the top of the splash guard panel 15 so that is it easily accessible to the wearer.

Figure 4:
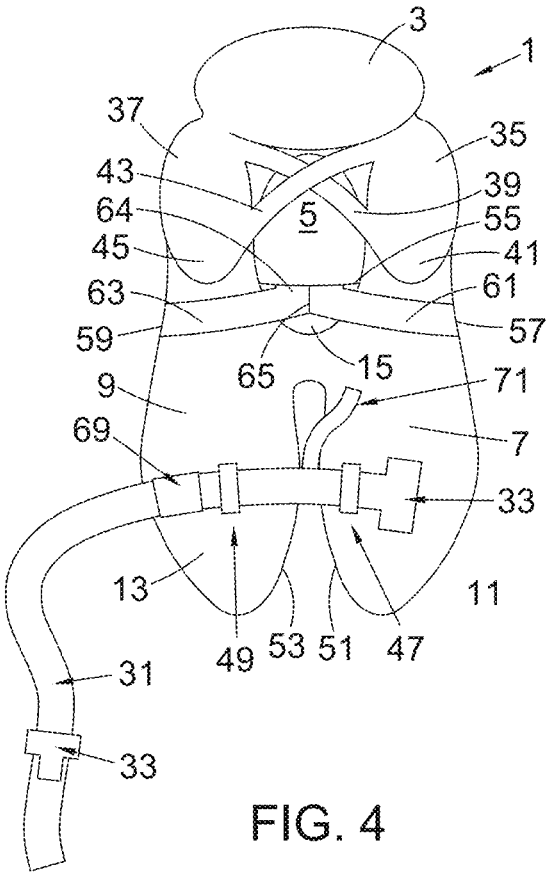
FIG. 4 shows rear view of the rear of the life preserver (in use), without the wearer, according to the embodiment of the invention.

As best shown in FIG. 4, the upper edge 55 of the splash guard panel 15 is connected to opposite outer edges 57 and 59 of the main body portion 3 by splash guard panel straps 61 and 63 which extend over the rear surface of the life preserver 1 (facing the wearer's body in use). In addition to being connected to the splash guard panel 15 at the upper edge 55, the straps 61 and 63 may be connected to the panel 15 along a line 65 extending downwardly from the upper edge 55 of the panel 15, and generally perpendicularly to the upper edge 55 of the panel 15, for a distance approximately equal to the width of the straps 61 and 63. The connection between the straps 61 and 63 tends to lift the splash guard panel 15 upwards towards the wearer's mouth when the life preserver 1 is inflated and may also tend to fold the outer edges 57 and 59 of the main body portion 3 so that they extend generally obliquely or parallel to the surface of the chest of the wearer and so have a similar orientation to the torso buoyancy sections 7 and 9 and the neck buoyancy sections 35 and 37.

The splash guard panel straps 61 and 63, when the life preserver 1 is inflated, form surface 64 which will be positioned against the wearer's chin in use, to provide a support for the chin and to tend to close the wearer's mouth.

The life preserver 1 may also be provided with a whistle 25 and a light 27. As shown in FIG. 1, reflective tape 73, to help the wearer be seen, may be provided at various positions on the life preserver 1.

Figure 3:
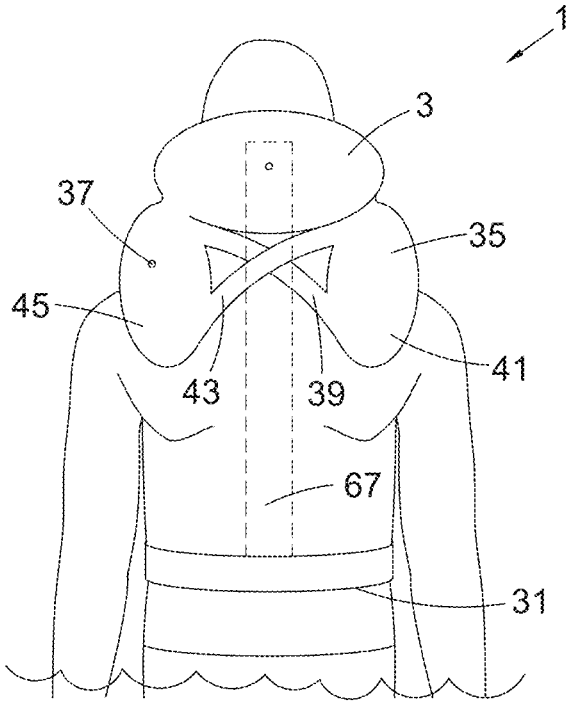
FIG. 3 shows rear view of the rear of the life preserver (in use), when worn by the wearer, according to the embodiment of the invention.

As best shown in FIGS. 2, 3 and 4, the main body portion 3 extends behind the wearer's neck and is provided with first and section neck buoyancy sections 35 and 37 which form symmetrically disposed lobes that extend above and behind the wearer's shoulders in use. The first and second neck buoyancy sections 35 and 37 are preferably integrally formed with the main body portion 3 (and the torso buoyancy sections 7 and 9) so that a single inflation chamber exists within the first and second neck buoyancy sections 35 and 37 and the main body portion 3 (and the torso buoyancy sections 7 and 9).

When inflated, each neck buoyancy section 35 and 37 may be an elongate member of generally elliptical or oval cross section.

The first and section neck buoyancy sections 35 and 37, in use, extend obliquely or generally perpendicularly to the surface of the wearer's back to provide the desired face plane angle and height of mouth (to be described in more detail later with reference to FIG. 7). The orientation of the first and second neck buoyancy portions 35 and 37 is provided by a strap arrangement. A first strap 39 is connected to the free, distal end 41 of the first neck buoyancy section and a second strap 43 connected to the free, distal end 45 of the second neck buoyancy section 37. As shown in FIG. 3, the first strap 39 is connected to the proximal end of the second neck buoyancy section 37 where this meets the main body portion 3. Similarly, the second strap 43 is connected to the upper part of the first neck buoyancy section 35 where this meets the main body portion 3. By selecting an appropriate length of the straps 39 and 43 the first and second neck buoyancy sections 35 and 37 may be pulled into the orientation shown when the life preserver 1 is inflated.

The straps 39 and 43 may be connected to one another at the point where they cross over.

As an alternative to the arrangement shown in FIG. 3, other strap arrangements may be used to provide the desired orientation of the first and second neck buoyancy sections 35 and 37. For example, the strap arrangement may comprise a single strap which connects the free, distal ends 41 and 45 of the first and second neck buoyancy sections 35 and 37 directly.

As mentioned above, the first and second neck buoyancy sections 35 and 37 are generally elliptical or oval in transverse cross-section, the width dimension being greater than the depth dimension. The first and second neck buoyancy sections 35 and 37 rotate relative to the main body portion 3 so that the larger dimension, instead of being generally parallel to the back of the wearer, extends generally perpendicular to or obliquely to the back of the wearer.

As shown in FIG. 3 a back strap 67, shown by dashed lines 67, may be provided which connects the main body portion 3 at a position behind the wearer's neck to the waist strap 31 and which extends generally in a direction along the wearer's spine.

Such a strap 67 may be particularly useful to ensure that the life preserver 1 fits securely to a smaller wearer.

The waist belt 31, as shown in FIG. 4, may be provided with a pocket 69 that contains a floating "buddy line" that allows survivors to link themselves in the water for safety.

The waist belt 31 may also include a lifting becket 71, as shown in FIGS. 1 and 4) which allows the wearer to be lifted from the water.

Some aspects of the formation of the life preserver 1 will now be described with reference to FIG. 5. The main body portion 3 is formed from two panels of coated fabric (typically a nylon or polyester coated with a polymer such as polyurethane), having the shape shown at 80 in FIG. 5. Two such panels 80 are welded or glued (or otherwise attached) together around the periphery as shown at 82 in FIG. 5. The splash guard panel 15 is formed by attaching the panel shown at 84 to the front one of the panels 80 at an appropriate position. The splash guard 15 straps 61 and 63 may be formed from a single piece of material as shown at 86.

Around the neck aperture 5, an additional neck section 87 is provided which, like the main body portion 3 is formed of two panels 88 of coated fabric that are welded or glued (or otherwise attached) together around the periphery as shown at 90. The additional neck section 87 has an aperture 92 which corresponds in shape to the neck aperture 5 of the main body portion 3.

Figure 5:
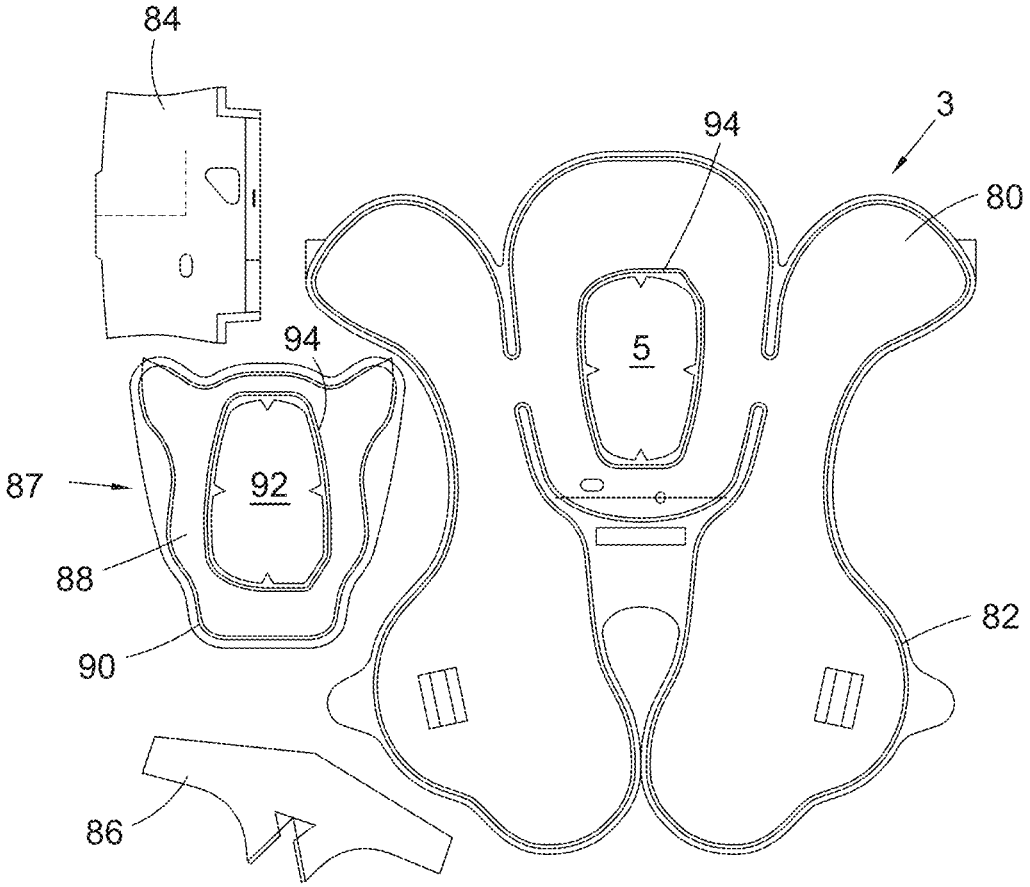
FIG. 5 shows various sheets of material used to form the life preserver.

To assemble the life preserver 1 with the additional neck section 87, the additional neck section 87 is positioned between the two panels 80 of the main body portion 3 so that its aperture 92 corresponds in orientation to the aperture 5 of the main body portion 3 (i.e. inverted from the orientation shown in FIG. 5). The lower one of the panels 80 of the main body portion 3 is welded or glued (or otherwise attached) to the lower one of the panels 88 of the additional neck section 87 around the periphery of the apertures 5 and 92, as indicated at 94. Likewise, the upper one of the panels 80 of the main body portion 3 and the upper one of the panels 88 of the additional neck section 87 are welded or glued (or otherwise attached) together around the periphery of the apertures 5, 92 as shown at 94. The welds (or other types of connections) 82, 90 and 94 create a fluid-tight chamber for the life preserver 1 to allow it to be inflated.

It should be appreciated that the lower and upper panels 80 of the main body portion are not directly connected to each other around the aperture 5 but instead have the additional neck section 87 as an intermediate element. This allows the distance between the upper and lower panels 80 of the main body portion 3 to increase when the life preserver 1 is inflated, creating a wall which extends against and around and grips the wearer's neck. The wall is formed by the panels 88 of the additional neck section 87 moving away from one another due to inflation so that they form an approximately cyclical wall around the wearer's neck.

Figure 6A:
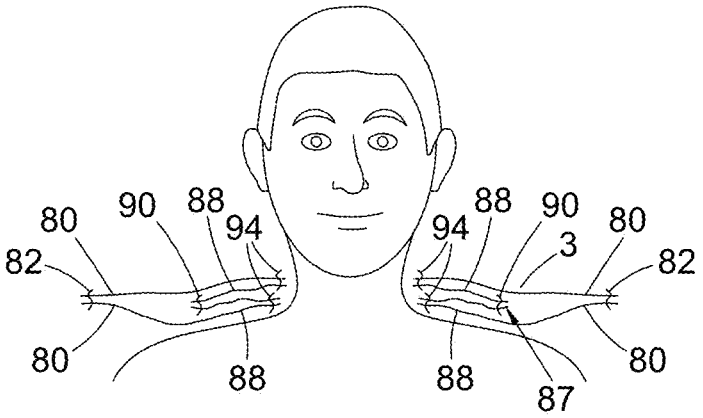
FIGS. 6A, B and C show the stages in the formation of a neck support according to the embodiment of the invention.
Figure 6B:
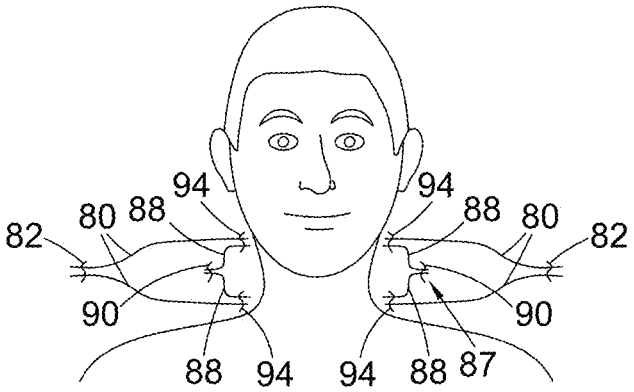
Figure 6C:
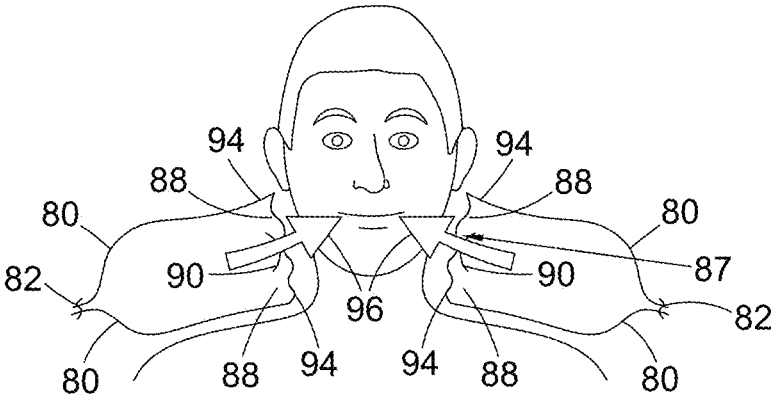

The arrangement of the additional neck section 87 can be better understood from FIGS. 6A, 6B and 6C. FIGS. 6A, 6B and 6C are cross sections taken along the line A-A in FIG. 2.

FIG. 6A shows the arrangement of the additional neck section 87 within the main body portion 3 when the life preserver is in the generally deflated state.

When inflation of the life preserver 1 begins the pressure of the inflation fluid causes the panels 80 of the main body portion 3 to move away from one another, as shown in FIG. 6B. This begins to change the orientation of the panels 88 of the additional neck section 87 from lying parallel from each other, and parallel to the panels 80 of the main body portion 3, as shown in FIG. 6A, to a position where the panels 88 of the additional neck section 87 are drawn apart from each other at the end distal to the welds 90.

FIG. 6C shows the configuration when the life preserver 1 is fully inflated. The panels 88 of the additional neck section 87, in the fully inflated state, form a generally cyclical wall that extends around the wearer's neck and exerts gentle pressure against the neck, as shown by the arrows 96.

Such an arrangement allows the life preserver unit to be securely and comfortably positioned around the wearer's neck when inflated, but allows the neck aperture 5 (and 92) to be large enough to allow easy donning even when the wearer is wearing a bulky jacket or coat with a hood.

Rather than being formed from two panels 88, joined at 90, the additional neck section 87 may be formed from a single panel.

Figure 7:
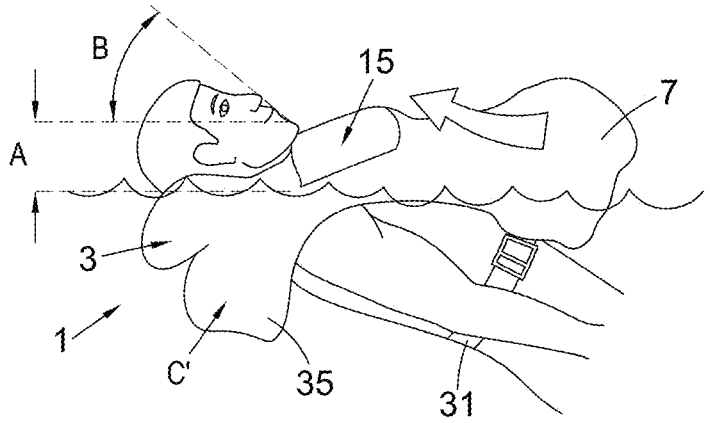
FIG. 7 shows a side view of the life preserver fitted to the torso of the wearer lying face-up in water.

FIG. 7 shows the mouth freeboard (the distance that the mouth of the wearer lies above the surface above the water at A). FIG. 7 also shows the face plane angle at B. The arrangement of the neck buoyancy sections 35 and 37 provides additional buoyancy at the neck of the wearer, as indicated by the arrow C, which tends to increase the mouth freeboard A and also gives a face plane angle of at least 40 degrees to the water surface.

It should be appreciated that the additional neck section 87 may be provided in accordance with the invention in a life preserver without the torso buoyancy sections 7 and 9 and/or the neck buoyancy sections 35 and 37. It should also be appreciated that the torso buoyancy sections 7 and 9 and/or the neck buoyancy sections 35 and 37 may be provided in accordance with the invention in a life preserver without the additional neck section 87.

It should also be appreciated that the splash guard panel 15 may be provided in accordance with the invention in a life preserver without the torso buoyancy sections 7 and 9 and/or the neck buoyancy sections 35 and 37. It should also be appreciated that the torso buoyancy sections 7 and 9 and/or the neck buoyancy sections 35 and 37 may be provided in accordance with the invention in a life preserver without the splash guard panel 15.

It should further be appreciated that the splash guard panel 15 may be provided in accordance with the invention in a life preserver without the additional neck section 87. It should also be appreciated that the additional neck section 87 may be provided in accordance with the invention in a life preserver without the splash guard panel 15.

The above embodiment is described by way of example. Many variations are possible without departing from the invention.

The invention claimed is:

1. A life preserver comprising:

an inflatable main body portion comprising a front layer of material having a front layer outer periphery, and a rear layer of material having a rear layer outer periphery, wherein the front layer of material and the rear layer of material are connected around the front layer outer periphery and the rear layer outer periphery, and wherein each of the front layer of material and the rear layer of material has an aperture, wherein the main body portion further comprises an additional layer of material that is connected to the front and rear layers of material around the apertures to form a surface that, upon inflation of the main body portion, encircles a wearer's neck, and wherein the additional layer of material is formed from two joined sheets of material that are configured to lie within and substantially parallel to the corresponding front and rear layers of material prior to inflation of the main body portion.

2. The life preserver of claim 1, wherein the surface is configured to grip the wearer's neck on inflation.

3. The life preserver of claim 1, further including first and second inflatable lobes extending from the main body portion which are configured to respectively occupy a position on a left and a right hand side of a wearer's torso when in use.

4. The life preserver of claim 1, including a panel of material mounted on a front surface of the main body portion adjacent to the apertures for protecting a wearer's airways from water splashes.

5. The life preserver of claim 4, wherein a portion of the panel is further coupled to the main body portion by a strap arrangement that passes through the apertures and is mounted to a rear surface of the main body portion.

6. The life preserver of claim 4, wherein the panel is mounted over a component attached to the main body portion.

7. The life preserver of claim 3, wherein the life preserver is configured such that at least one of the first and second inflatable lobes extends obliquely or perpendicularly with respect to an adjacent surface of the wearer's torso when in use.

8. The life preserver of claim 3, wherein the first and second inflatable lobes occupy a position on a left and a right hand side of a front of the wearer's torso when in use.

9. The life preserver of claim 8, wherein the first and second inflatable lobes are coupled together at a position spaced apart from the main body portion such that adjacent facing edges of the first and second inflatable lobes abut one another in use, the first and second inflatable lobes moving independently of one another and tending to cause self-righting of the wearer when lying face down in water.

10. The life preserver of claim 9, wherein the first and second inflatable lobes are coupled together by a strap arrangement that also mounts the life preserver to a wearer's waist in use.

11. The life preserver of claim 3, wherein the first and second inflatable lobes occupy a position on a left and a right hand side of a back of the wearer's torso when in use.

12. The life preserver of claim 11, wherein the first and second inflatable lobes are coupled together at a position spaced apart from the main body portion so that the first and second inflatable lobes extend obliquely or perpendicularly with respect to the back of the wearer's torso.

13. The life preserver of claim 3, including a first set of the first and second inflatable lobes that occupy the position on a left and a right hand side of a front of the wearer's torso when in use and a second set of the first and second inflatable lobes that occupy the position on a left and a right hand side of a back of the wearer's torso when in use.

14. The life preserver of claim 1, wherein the front and rear layers of material are attached to the additional layer of material around a periphery of the apertures in the front and rear layers of material.

15. The life preserver of claim 1, wherein the additional layer of material, upon inflation of the main body portion, forms a generally cylindrical wall around the wearer's neck.

16. A life preserver comprising:

an inflatable main body portion comprising a front layer of material having a front layer outer periphery, and a rear layer of material having a rear layer outer periphery, wherein the front layer of material and the rear layer of material are connected around the front layer outer periphery and the rear layer outer periphery, and wherein each of the front layer of material and the rear layer of material has an aperture;

first and second inflatable lobes extending from the main body portion, a first set of the first and second inflatable lobes that occupy the position on a left and a right hand side of a front of the wearer's torso when in use and a second set of the first and second inflatable lobes that occupy the position on a left and a right hand side of a back of the wearer's torso when in use;

wherein the main body portion further comprises an additional layer of material that is connected to the front and rear layers of material around the apertures to form a surface that, upon inflation of the main body portion, encircles a wearer's neck, wherein the additional layer of material is formed from two joined sheets of material that are configured to lie within and substantially parallel to the corresponding front and rear layers of material prior to inflation of the main body portion.

* * * * *